United States Patent [19]

Sasaki et al.

[11] Patent Number: 4,922,300

[45] Date of Patent: May 1, 1990

[54] IMAGE FORMING APPARATUS AND DEVELOPING DEVICE THEREFOR

[75] Inventors: Nobukazu Sasaki; Toshirou Kasamura, both of Yokohama; Masashi Ohashi, Tokyo; Naoki Okuda, Kawasaki; Toshihiko Kusomoto, Tokyo, all of Japan

[73] Assignee: Canon Kabushiki Kaisha, Tokyo, Japan

[21] Appl. No.: 403,005

[22] Filed: Sep. 6, 1989

Related U.S. Application Data

[63] Continuation of Ser. No. 71,316, Jul. 9, 1987, abandoned.

[30] Foreign Application Priority Data

Jul. 11, 1986 [JP] Japan ..... 61-163477

[51] Int. Cl.[5] ..... G03G 15/06

[52] U.S. Cl. ..... 355/245; 355/260

[58] Field of Search ..... 355/245, 260, 326, 327; 118/645, 648, 651, 657, 658

[56] References Cited

U.S. PATENT DOCUMENTS

| | | | |
|---|---|---|---|
| 3,609,029 | 9/1971 | Egnaczak | 355/256 |
| 3,953,121 | 4/1976 | Reichart | 355/245 |
| 3,970,042 | 7/1976 | Rees | 355/259 X |
| 3,987,756 | 10/1976 | Katayama et al. | 355/245 X |
| 4,114,998 | 9/1978 | Shimizu et al. | 355/200 |
| 4,132,476 | 1/1979 | Wetzel | 355/215 |
| 4,203,386 | 5/1980 | Blochl et al. | 355/245 X |
| 4,339,196 | 7/1982 | Beck et al. | 355/251 |
| 4,605,299 | 8/1986 | Mochimaru | 355/200 |
| 4,615,605 | 10/1986 | Kida et al. | 355/245 X |
| 4,705,394 | 11/1987 | Watanabe | 355/245 |
| 4,710,016 | 12/1987 | Watanabe | 355/326 |

FOREIGN PATENT DOCUMENTS

| | | | |
|---|---|---|---|
| 2529835 | 1/1977 | Fed. Rep. of Germany . | |
| 3244515 | 6/1984 | Fed. Rep. of Germany | 355/245 |
| 3504939 | 8/1985 | Fed. Rep. of Germany . | |
| 57-204566 | 6/1982 | Japan . | |
| 57-204567 | 12/1982 | Japan . | |
| 61-20068 | 1/1986 | Japan | 355/245 |
| 61-63866 | 4/1986 | Japan . | |
| 61-132965 | 6/1986 | Japan | 355/245 |
| 2184396A | 6/1987 | United Kingdom . | |

*Primary Examiner*—Fred L. Braun

*Attorney, Agent, or Firm*—Fitzpatrick, Cella, Harper & Scinto

[57] ABSTRACT

An image forming apparatus for forming a developed image includes a developing device for developing an image on an image bearing member, a passage along which the developing device is movable continuously between an inside position where the developing device is inside the apparatus and an outside position where the developing device is at least partly outside the apparatus, a driver for automatically moving the developing device along the passage and one or more pressing members for pressing the developing device toward the image bearing member. The driver includes a driving source and transmission which are operative to move the developing device in response to the opening of a cover which covers an inlet to the passage.

22 Claims, 5 Drawing Sheets

IMAGE FORMING APPARATUS AND DEVELOPING DEVICE THEREFOR

This application is a continuation of application Ser. No. 071,316 filed July 9, 1987, now abandoned.

FIELD OF THE INVENTION AND RELATED ART

The present invention relates to an image forming apparatus such as copying machine, recording machine and printer, more particularly to an image forming apparatus and a developing device therefor, wherein the developing device is detachably mountable into the image forming apparatus.

Conventionally, a developing apparatus is set in place in an image forming apparatus such as a copying machine by an expert service operator, and thereafter the user operator does not take the developing device out of the copying machine. Therefore, it has been dominant that a service man manually inserts the developing device into the assembly to a position, for example, a position where the developing device is near a photosensitive member but is not contacted to the photosensitive member, and then, a manual lever is operated to urge the developing device to the photosensitive drum to correctly position it with respect to the photosensitive member. This type is disclosed in U.S. Pat. Nos. 4,373,468 and 4,583,832.

Recently, however, a new type of image forming apparatus becomes widely used wherein the developing device is replaceable with another developing device containing a different color toner such as red and blue in addition to black so as to permit image formation with a different color. With this trend, it is more frequent that the user operator himself mount the developing device into the apparatus or demount it therefrom. This type is disclosed, for example, in U.S. Pat. Nos. 4,470,689, 4,500,195 and 4,575,221 wherein a process unit containing a photosensitive member and developing means is replaced; and U.S. Ser. No. 802,537 filed on Nov. 27, 1985, now abandoned, and assigned to the assignee of this application, wherein the apparatus contains two developing devices selectively usable, and wherein one of the developing devices are made exchangeable. There is another proposal, as disclosed U.S. Ser. No. 844,718 filed on Mar. 27, 1986, now U.S. Pat. No. 4,801,966, and assigned to the assignee of the present application, wherein two developing devices are made selectively operable. Another proposal has been made in U.S. Pat. Nos. 4,615,612 and 4,622,916 wherein the apparatus has a turret type developer accommodating means.

However, since all of the above described systems involve manual exchange or replacement of the developing device, it requires cumbersome work and involves the possibility of the developing device hitting the apparatus or the like, thus imparting unnecessary shock or vibration to the developing device.

On the other hand, considering the developing operation, the size of the developer particles becoming smaller in order to improve the image quality, more particularly the sharpness, with the result that the fluidability of the developer becomes higher when the developer is mixed with air. Therefore, it becomes required that the developing device is handled with great care, since otherwise the developer becomes distributed in the container non-uniformly, or the developer is scattered out.

Generally, the non-uniform distribution of the developer in the container is solved by stirring the developer, and in consideration of variations in the manner of handling by various users, the stirring period is made relatively longer to cover wide variations. Therefore, the time required until a first copy is obtained is long after the developing device is exchanged, or after the developer is supplied in the type of the device wherein the developing device is demounted from the apparatus to supply the developer. Where the developing device is limited by a stopper when the developing device is mounted into the apparatus, the degree of resulting non-uniform distribution of the developer and the scattering vary depending on the speed at which the user abuts the developing device to the stopper.

More particularly, in the system wherein the mounting of the developing device is performed by the user, the mounting operation is like closing a drawer by the user, and therefore, the shock imparted to the developing device is different depending on the user's peculiarity in the force of mounting it. If it is strong, the strong shock is applied in the longitudinal direction of the developing device (in the system wherein the developing device is inserted through a front door of the apparatus in a direction of a generating line of a photosensitive drum contained therein), the developer in the container becomes non-uniformly distributed in the longitudinal direction. And, the developer having been urged to the rear side may blow out through a clearance around a cover of the developing device to scatter out. Particularly, when the developer is replenished, a toner bottle containing a supply of developer to be replenished is shaked so as to increase the fluidability of the developer in order for the developer therein to be completely removed from the developer bottom into the container of the developing device. This easily scatters the developer.

When the developing device is exchanged, the developer contained in the developer container in the developing device usually has been kept stationary for a relatively long period of time, and therefore, the fluidability is not so high. However, if it becomes once non-uniformly distributed, it is required that the developer be positively and relatively strongly stirred by stirring means such as stirring rod. Therefore, the time period for pre-rotation of the photosensitive member to prepare the apparatus for image forming operation, has to be longer. This also results in the longer time period to the first copy from the start of the copying apparatus.

From the users standpoint, various positioning means or other means have to be operated when the developing device is demounted or mounted, and therefore, it is cumbersome.

SUMMARY OF THE INVENTION

Accordingly, it is a principal object of the present invention to provide an image forming apparatus wherein a process unit containing a developing function or a developing unit containing a developing device is easily exchanged with certainty.

It is another object of the present invention to provide an image forming apparatus wherein an automatic operation is assured in accordance with a position of the developing device.

It is a further object of the present invention to provide an image forming apparatus wherein the developing device is substantially free from unnecessary shock or vibration thereto.

It is a further object of the present invention to provide an image forming apparatus wherein the developing operation can be started without delay.

It is a further object of the present invention to provide an image forming apparatus wherein the developer can be supplied into the developing device without difficulty.

It is a further object of the present invention to provide a developing device suitable for the above image forming apparatus.

It is a further object of the present invention to provide a developing unit containing plural developing devices, wherein the developing devices can be loaded into the developing unit at correct positions when the developing devices are exchanged.

According to an embodiment of the present invention, there is provided an image forming apparatus including a developing device and moving means for moving the developing device between a developing device access port and a developing device operating position where the developing device is operable and means for automatically moving the developing device in response to an actuating signal. With this apparatus, the developing device can be retracted from or mounted into the apparatus automatically, whereby the speed of movement of the developing device for the retraction and mounting can be controlled, and therefore the shock to the developing device at the ends of mounting and demounting operation (positioning by abutment), can be precluded. Thus, the possibility of non-uniform distribution of the developer and the scattering of the developer can be prevented, so that the mounting and demounting operation of the developing device can be made easier.

In the system wherein the developing device is mounted into or demounted from the apparatus, the movement of the developing device is automatic between the developing device access door and the developing device operating position, and therefore, the mounting operation of the developing device to the apparatus and the speed of the developing device at which it is abutted or pressed to the photosensitive drum can be stabilized, solving the above discussed problems.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
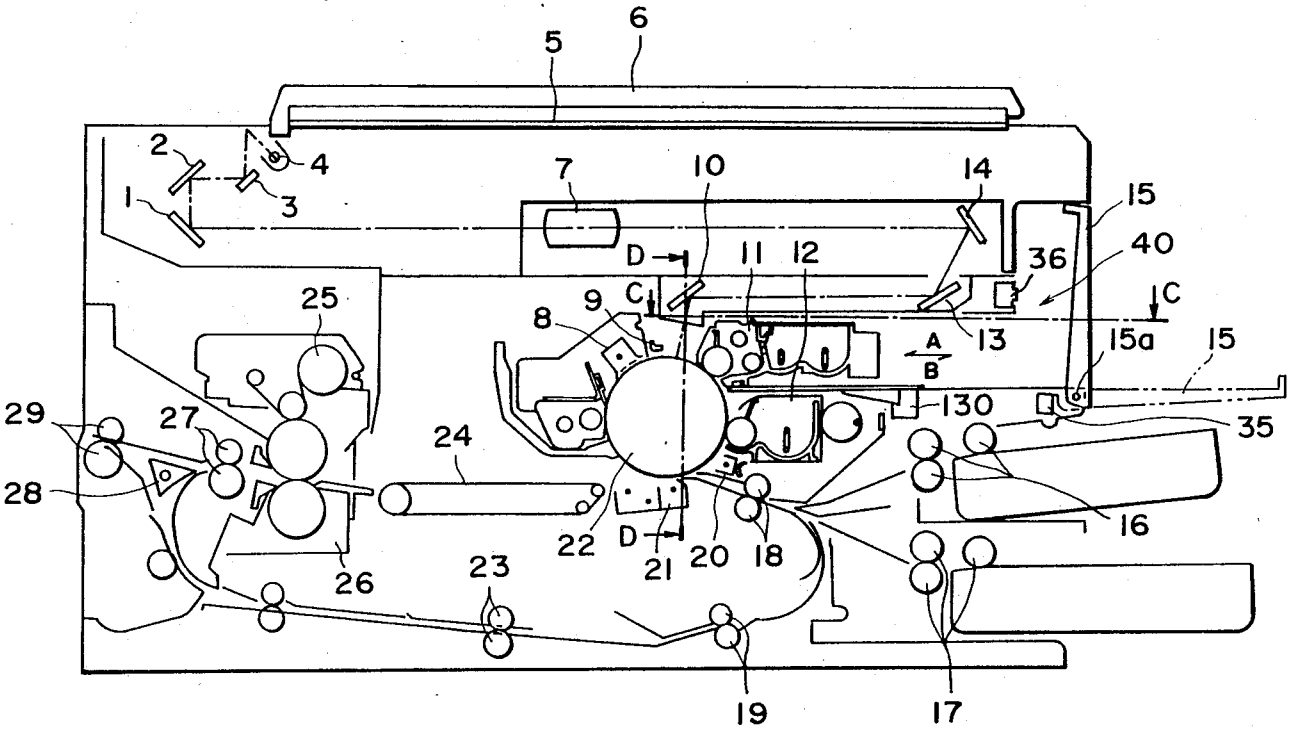
FIG. 1 is a longitudinal sectional view of an image forming apparatus in the form of a copying machine according to a first embodiment of the present invention.

Referring to FIG. 1, there is shown a copying apparatus as an example of an image forming apparatus according to an embodiment of the present invention, wherein the copying apparatus is capable of producing a duplex copy.

The copying apparatus of FIG. 1 contains known structures of optical means, a sheet transporting mechanism, and an image fixing device.

An original to be copied is placed on an original supporting glass platen 5 and is illuminated by an original illuminating lamp 4, and at this time, the original is covered by an original cover 6. The light reflected by the original is introduced to a third mirror 3, a second mirror 2 and a first mirror 1, and further to a lens 7 which is effective to provide a desired magnification of the copy. The light is further introduced to a fourth mirror 14, a fifth mirror 13 and a sixth mirror 10, and finally is incident on a surface of a photosensitive drum 22 (an electrostatic latent image bearing member) which has been uniformly charged electrically by a primary charger 8. The surface of the photosensitive drum 22 has been electrically discharged by a blank exposure lamp 9 before it is uniformly charged by the primary charger 8. Designated by a reference numeral 15 is a cover for covering an access port for a developing device 11, through which the developing device 11 is retracted from and inserted into the apparatus. The developing device 11 develops the electrostatic latent image on the photosensitive drum 22, which is formed by the application of the light onto the photosensitive drum 22. A pre-transfer charger 20 is effective to control the state of electric charge after the developing operation. The developed image is transferred from the photosensitive drum 22 onto the transfer sheet, and the transfer sheet is separated from the photosensitive drum 22, by a transfer-separation charger 21. The sheet separated from the photosensitive drum 22 is transported to a roller type image fixing device 26 with a cleaning web 25 on a conveyor belt 24. A deflector 28 functions to selectively direct the sheet having passed through the image fixing device 26 and discharging rollers 27 either to a discharge tray or to a duplex copy conveying mechanism 23. Discharge rollers 29 function to discharge the sheet outside the apparatus.

The sheet is supplied one by one from an upper sheet cassette or a lower sheet cassette by registration roller 16 or 17, and then it is introduced to the image transfer station by a registration roller 18 into alignment with an image on the photosensitive drum 22. The sheet introduced into the duplex copy conveyor portion, is once accommodated there, and then fed out to the registration roller 18 one by one by a registration roller 19, so as to be subjected to an additional image transfer operation.

The exemplary image forming apparatus is a copying machine, but it may be of another type, such as a laser beam printer or the like.

Two developing devices are provided in this embodiment. A developing device 12 contains a black toner and is movable between an operative position and a non-operative position. The developing device 12 has a different configuration from another developing device 11 which is movable along a transportation passage which will be described in detail hereinafter.

Figure 2:
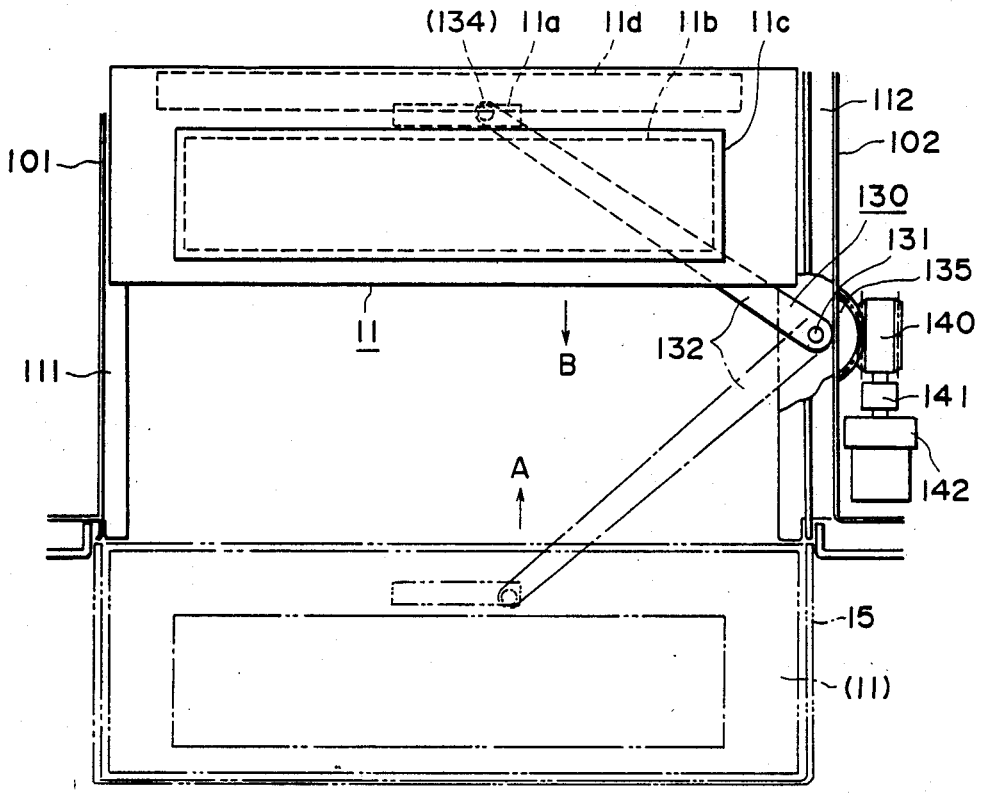
FIG. 2 is an enlarged longitudinal sectional view from the top along line C—C of FIG. 1.

The developing device 11 has a portion 11*a* for receiving a driving force from an automatic developing device moving means which will be described in detail hereinafter, while the developing device 12 is not provided with such a portion. Therefore, even if the developing device 12 is loaded to the transportation passage, that is, it is placed erroneously as if it is a developing device 11, it is not moved to the operative position, so that the developing device is prevented from being set at a wrong position. As shown in FIG. 2, a front plate 101 and a rear plate 102 are provided with thrust guide 111 and 112 securedly fixed thereto to receive loads from the developing device 11. The cover 15 for covering the access port 40, as shown at a right position of FIG. 1, is rotatable about a shaft 15*a* fixed to the front and rear plates of the apparatus. When the cover 15 is at the closed position indicated by solid lines in FIG. 1, the door 15 is maintained at its position by a magnet catch provided on the apparatus. When it assumes an open position as indicated by chain lines, an end of the cover 15 abuts a stay of the apparatus to maintain the open position. The inside of the cover 15 is provided with a channel or channels similar to the thrust guides 111 and 112, so as to allow the developing device 11 to slide into and out of the apparatus. In the neighborhood of the abutment of the stay to the cover 15, a microswitch 35 (FIG. 1) is provided to detect that the cover 15 is opened.

Figure 3:
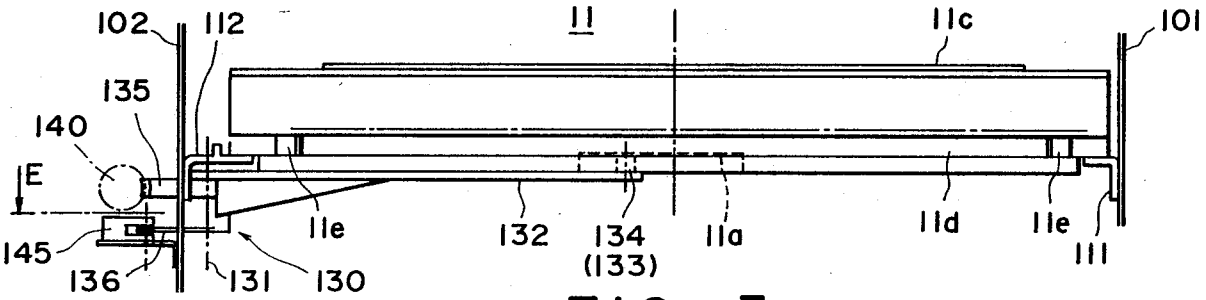
FIG. 3 is an enlarged cross-sectional side view along line D—D of FIG. 3.
Figure 4:
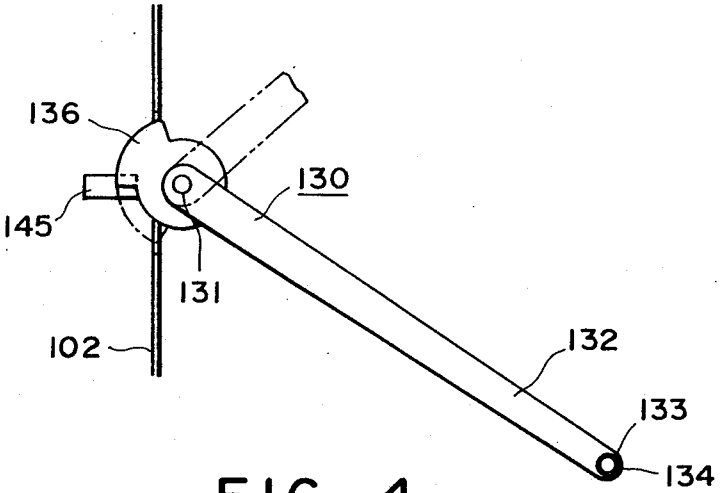
FIG. 4 is an enlarged plan view seen from E of FIG. 3.

As shown in FIGS. 2 and 3, the bottom surface of the developing device 11 is provided with a 10 groove 11*a* constituted by a rib for engagement with a pin of a driving arm 130. At the top of the developing device, there is a cover 11*c* for closing and opening a developer supply aperture 11*b*. The developing device 11 has a developing sleeve 11*d* having flanges at the opposite longitudinal ends thereof, to which rotatable abutment rollers 11*e* are rotatably mounted, which are abutted to the photosensitive drum 22 to maintain a predetermined clearance between the photosensitive drum 22 and the surface of the developing sleeve 11*d*.

Below a movable region of the developing device 11, a driving arm 130 is disposed. The driving arm 130 is rotatable about a rotational axis or shaft 131 extending substantially vertically. The driving arm 130 includes an elongated arm 132 (FIG. 2) extending toward the developing device, a pin 133 fixed to an end portion of the arm 132 and a pressure roller 134 rotatably mounted to the pin 133. The other end of the arm 132 is penetrated through an opening 102 of the rear plate, and is formed into a sector gear 135, which is meshed with a worm (driver) gear 140. The worm gear 140 is operatively coupled to a reversible DC motor through a torque limiter 141. A photointerruptor 145 (FIG. 3) for detecting a rotational amount of the arm is provided to an outside of the rear plate 102. The photointerruptor 145 is effective to detect a slot formed in a disk 136 of a driving arm 130, thus sensing the position of the driving arm 130, thus constituting a developing device position detecting means, in effect.

Figure 5:
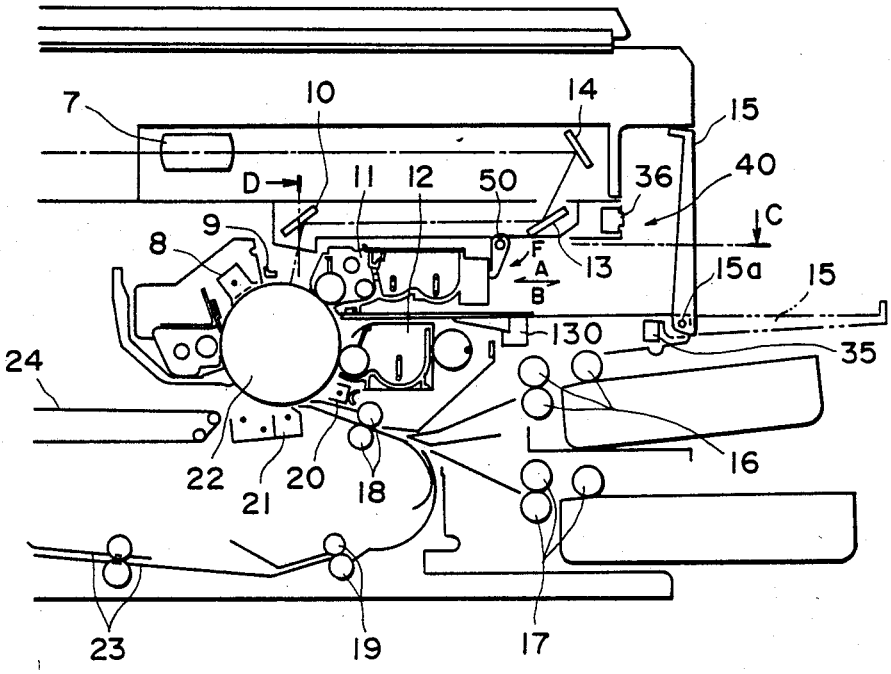
FIG. 5 is a sectional view of a part of the copying apparatus wherein the present invention is incorporated.

In FIGS. 1 and 5, the driving arm 130 is moved by 90 degrees.

In operation, when the level of the contained developer reaches down a predetermined level during operation of the copying apparatus, an unshown developer detecting means operates to provide a signal through an unshown connecting means to a controller in the apparatus, in response to which a lamp is lit on an operating panel of the apparatus to instruct the operator to supply the developer. Then, the operator opens the cover 15, by which the switch 35 is actuated. If the image forming process has been completed in the apparatus, the motor 142 is unlocked, whereby the twisting of the torque limiter 141 charged by the spring force, is eased so that the pressure for pressing the developing device 11 to the photosensitive drum is released.

Then, the motor 142 is energized to start rotation in the reverse direction. This moves the developing device 11 in a direction indicated by an arrow B by the pressure roller 134 adjacent an end of the arm 134 pushing one side surface of the groove 11*a* below the developing device 11. When a leading portion of the developing device 11 approaches the cover 15 by rotation of the driving arm 130, the photointerruptor 145 detects the slot of the disk 136. The motor 142 stops its rotation a predetermined period after the detection. The predetermined period is preset to correspond to the proper amount of movement of the developing device. By this, the developing device 11 is brought on the opened cover 15. With this state, the operator opens the cover 11*c* of the developer supplying inlet 11*b* and can supply the developer. Also, it is possible to exchange the developing device with another developing device containing a different color developer. As will be understood from the foregoing, when the cover 15 is opened during the time when the copying apparatus is not operated, the developing device is automatically brought above the cover 15.

After the developer is supplied, or after the developing device is exchanged and placed on the cover 15, a switch 36 (FIG. 1) which is disposed in the region encompassed by the cover 15, that is, the inside region when the cover 15 is closed, is depressed, the motor 142 starts rotating in the forward direction. Then, the developing device 11 now on the cover 15 is moved in the direction of an arrow A by the pressure roller 134 in accordance with rotation of the driving arm 130, so that the developing device 11 is inserted into the apparatus.

When the driving arm 130 further rotates to place the pressing roller 134 at that end of the movable range which is near the photosensitive drum 22, the detecting photointerruptor 145 detects the slot of the disk 136 and informs the controller of the apparatus that the developing device 11 has reached the predetermined position. The motor 142 is further rotated for a predetermined period of time from this point, so that the spring of the torque limiter 141 is charged, whereby the pressure roller 134 at the end of the arm 130 urges the developing device in the direction of the arrow A. By this, the developing device 11 abuts the photosensitive drum 22, more particularly, the spacer rollers 11*e* which are coaxially mounted to the sleeve 11*d* to maintain the clearance abut the photosensitive drum 22.

Thus, the loading and pressing operation for the developing device 11 can be mechanically and automatically performed in the above described manner, and therefore, the moving speed and the pressing speed can be controlled to be constant. This eliminates the possibility of imparting impact vibrations to the developing device 11 in the loading and pressing operations. Accordingly, the developer in the developer container is prevented from non-uniform distribution or from scattering out through a small clearance of the developing device.

Figure 6:
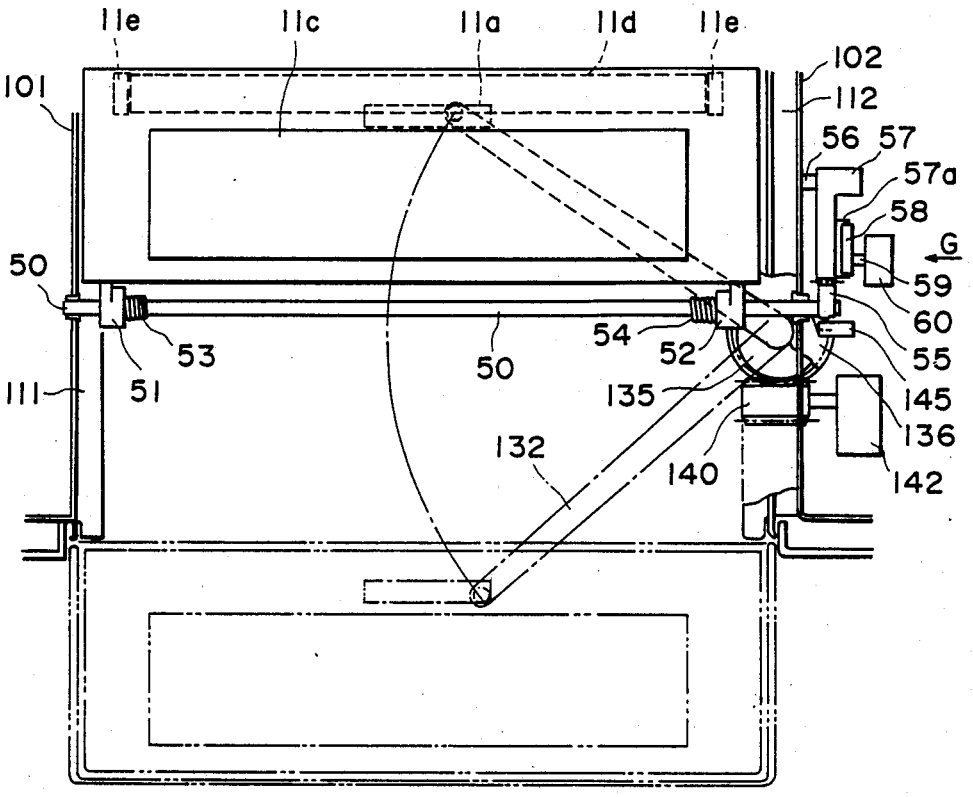
FIG. 6 is a enlarged longitudinal plan view taken along line C—C of FIG. 5.
Figure 7:
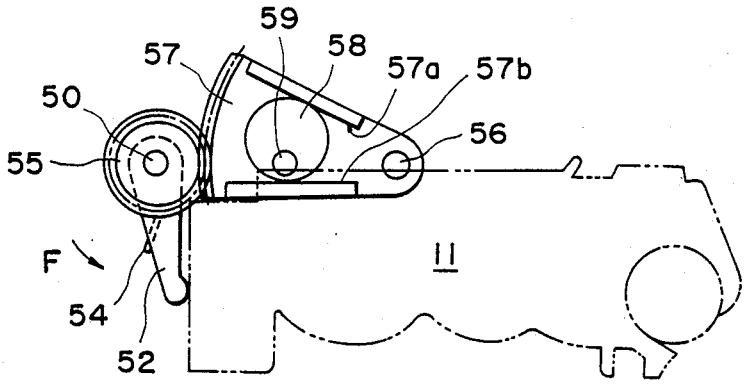
FIG. 7 is an enlarged side view seen from G of FIG. 6.

Referring to FIGS. 5–7, there is shown another embodiment. In this embodiment, when the operator opens the cover 15 in response to instructions of developer supply from the apparatus, a switch 35 is actuated; and if the image forming process is completed in the apparatus, a clutch 50 shown in FIG. 6 engages so as to rotate an eccentric cam 58 on a shaft 59 by a predetermined amount, whereby a sector gear 57 is rotated in the clockwise direction in FIG. 7 about a shaft 56. This rotates a gear 55 meshed therewith and its shaft 50 in the clockwise direction (arrow F). The shaft 50 lifts the pressing arms or members 51 and 52 through coil springs 53 and 54 to such a position as is out of the passage of the developing device 11 movement.

Similarly to the above described embodiment, the developing device 11 is brought above the cover 15 by the reverse rotation of the motor 142. After the developer supply or after the developing device is exchanged the switch 36 is actuated to rotate the motor 142 in the forward direction, so that the developing device 11 is inserted into the apparatus. Then, the driving arm 130 further rotates, and the pressure roller 134 reaches the photosensitive drum side end, the detecting photointerruptor 145 produces a signal to stop the motor 142.

Subsequently, the clutch 60 operates to bring the eccentric cam 58 and the sector gear 57 back to the position shown in FIG. 7, and the gear 55 and the shaft 50 rotate in the direction F. The pressing arms 51 and 52 are rotated in the direction F through springs 53 and 54 on the shaft 50 which determines the level of the pressure. Thus, the developing device 11 is pressed to the photosensitive drum by way of the spacer rollers 11*e* for maintaining the clearance.

This embodiment is particularly preferable when a higher pressing force is required from the developing device 11 to the photosensitive member, since the torque required for the reversible motor 142 which has to provide a relatively large stroke with a long arm, can be reduced.

The embodiments described in the foregoing are preferable when the positional relationship between the developing sleeve and the photosensitive drum (the clearance therebetween) has to be highly correct, since the photosensitive drum itself is used as a positioning member, to which the developing device is abutted by pressure means with a gap spacer determining the amount of the clearance.

However, for a developing system such as a conventional magnetic brush development wherein, the positional relationship is not necessarily of such an accuracy as of the order of several tens of microns, the pressing means for abutting the developing device to the photosensitive drum is not necessarily required. Also, when the developing device is not externally supplied with a driving force, a pressing means for a positioning means for preventing the developing device from displacing from a predetermined position is not always necessary. When the present invention is applied to those types of developing systems, it is understood that the advantages of the present invention of smoothly moving the developing device at a predetermined speed and of preventing the toner scattering can be provided, too.

As described in the foregoing, according to the present invention, the mounting of the developing device into the copying apparatus and/or the abutting and pressing thereof to the photosensitive drum, is performed automatically, and therefore, the mounting and demounting speed of the developing device 11 can be stabilized with the reduction of the shock or vibration imparted thereto during the mounting and pressing operation, whereby the possible non-uniform distribution of the developer in the developing device and the scattering of the developer from the developing device can be prevented.

The developing device is released and brought out of the apparatus by a very simple operation when the developer is to be supplied, and the developing device is maintained stably on the cover, so that the operator can supply the developer without difficulty.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming a developed image, comprising:

a developing device for developing an image on an image bearing member;

a passage along which said developing device is movable between an inside position where said developing device is inside said apparatus and an outside position where said developing device is at least partly outside said apparatus;

a movable cover for covering an opening to said passage; and means for moving said developing device along said passage, said moving means including a driving source for outputting a driving force and transmission means for transmitting the driving force to said developing device to move it, wherein said moving means is responsive to an opening operation of said movable cover to move said developing device from the inside position to the outside position.

2. An apparatus according to claim 1, wherein said cover has a support for movably supporting said developing device when said cover is opened.

3. An apparatus according to claim 2, wherein said moving means moves said developing device from the inside position onto said comver, and wherein said transmission means is in engagement with said developing device even when said developing device is supported by said cover support.

4. An apparatus according to claim 1, 2 or 3, wherein said developing device includes an opening for enabling supply of developer thereto when said developing device is supported by said cover support.

5. An image forming apparatus for forming a developed image, comprising:

a developing device for developing an image on an image bearing member;

a passage along which said developing device is movable between an inside position where said developing device is inside said apparatus and an outside position where said developing device is at least partly outside said apparatus;

means for automatically moving said developing device along said passage, said automatic moving means including a driving source for outputting a driving force and transmission means for transmitting the driving force to said developing device to move it; and a movable cover for covering an opening to said passage;

wherein said automatic moving means moves said developing device through said passage toward the inside position, and is responsive to opening of said cover to move said developing device through said passage toward the outside position.

6. An apparatus according to claim 5, wherein said cover has a support for movably supporting said developing device when said cover is opened.

7. An apparatus according to claim 6, wherein said moving means moves said developing device from the inside position onto said cover, and wherein said transmission means is in engagement with said developing device even when said developing device is supported by said cover support.

8. An apparatus according to claim 5, 6 or 7, wherein said developing device includes an opening for enabling supply of developer thereto when said developing device is supported by said cover support.

9. An apparatus according to claim 5, 6 or 7, further comprising means for pressing said developer device, which has been moved from the outside position by said automatic moving means from the outside position, toward the image bearing member to position said developing device relative to the image bearing member, wherein said pressing means is engageable with said developing device at a position different from a position where said transmitting means is engaged with said developing device, and wherein said pressing means is retractable from said passage of said developing device when said developing device is automatically moved by said automatic moving means.

10. An image forming apparatus for forming a developed image, comprising:

a developing device for developing an image on an image bearing member;

a passage along which said developing device is movable between an inside position where said developing device is inside said apparatus and an outside position where said developing device is at least partly outside said apparatus;

means for automatically moving said developing device along said passage;

means for pressing said developing device toward the image bearing member to position said developing device relative to the image bearing member, said pressing means being retractable from said passage of said developing device when said developing device is automatically moved by said automatic moving means;

a cover for opening and closing said passage; and safety means, including drive means and means limiting the movement of said drive means, for permitting operation of said moving means when said cover is opened.

11. An apparatus according to claim 10, wherein said cover includes a covering plate having an end adjacent which it is rotatably supported on said apparatus, and wherein said covering plate, when it is opened, supports said movable developing device.

12. An image forming apparatus for forming a developed image, comprising:

a movable device for developing an image on an image bearing member;

a passage along which said developing device is movable between an inside position where said developing device is inside said apparatus and an outside position where said developing device is at least partly outside said apparatus;

means for automatically moving said developing device along said passage, said automatic moving means including a driving source for outputting a driving force and transmission means for transmitting the driving force to said developing device to move it; and means for pressing said developing device, after being moved by said automatic moving means from the outside position, toward the image bearing member to position said developing device relative to the image bearing member, wherein said pressing means is engageable with said developing device at a position different from a position where said transmitting means is engaged with said developing device, and wherein said pressing means is retractable from said passage of said developing device when said developing device is automatically moved by said automatic moving means.

13. An apparatus according to claim 12, further comprising means for detecting said developing device and means responsive to said detecting means to stop said developing device.

14. An apparatus according to claim 12, further comprising a switch for moving said developing device toward said outside position and control means for operating said moving means in response to actuation of said switch.

15. An apparatus according to claim 12, wherein said moving means comprises a reversible motor.

16. An apparatus according to claim 12, wherein said passage has a length in a direction of movement of said developing device, longer than a length of said developing device measured in the direction.

17. An apparatus according to claim 12, further comprising means for forming a latent image on the image bearing member and an additional developing device having a different configuration from said movable developing device.

18. An apparatus according to claim 17, wherein said passage is disposed below an optical element of said latent image forming means and above said additional developing device.

19. An apparatus according to claim 17, wherein said movable developing device is provided with a portion for receiving the driving force from said moving means, and said additional developing device is independent from said driving source.

20. An apparatus according to claim 19, wherein said additional developing device contains a black developer which is different in color from a color of the developer contained in said movable developing device.

21. An apparatus according to claim 19, wherein said pressing means includes first and second pressing members for pressing opposite ends of the developing device in a direction of the developing device movement, and includes driving means common to the first and second pressing members.

22. An apparatus according to claim 19, wherein said pressing means presses a rear end of said movable developing device, with respect to a direction of movement of said movable developing device toward the image bearing member.

* * * * *

UNITED STATES PATENT AND TRADEMARK OFFICE

CERTIFICATE OF CORRECTION

PATENT NO. : 4,922,300

DATED : May 1, 1990

INVENTOR(S) : NOBUKAZU SASAKI, ET AL.

It is certified that error appears in the above-identified patent and that said Letters Patent is hereby corrected as shown below:

On the title page, item [75], the last inventor's name reading "Toshihiko Kusomoto" should read --Toshihiko Kusumoto--.

COLUMN 1

Line 45, "are" should read --is--.
Line 46, "disclosed" should read --disclosed in--.

COLUMN 2

Line 52, "users" should read --user's--.

COLUMN 5

Line 32, "10" should be deleted.

COLUMN 8

Line 44, "comver," should read --cover,--.

UNITED STATES PATENT AND TRADEMARK OFFICE

CERTIFICATE OF CORRECTION

PATENT NO. : 4,922,300

DATED : May 1, 1990

INVENTOR(S) : NOBUKAZU SASAKI, ET AL.

It is certified that error appears in the above-identified patent and that said Letters Patent is hereby corrected as shown below:

COLUMN 9

Line 22, "from the outside position" should be deleted.

Signed and Sealed this

Twenty-second Day of January, 1991

*Attest:*

HARRY F. MANBECK, JR.

*Attesting Officer*

*Commissioner of Patents and Trademarks*